United States Patent [19]

Solheim

[11] Patent Number: 4,653,758

[45] Date of Patent: Mar. 31, 1987

[54] GOLF BALL

[76] Inventor: Karsten Solheim, 501 Wakonda La., Phoenix, Ariz. 85023

[21] Appl. No.: 768,368

[22] Filed: Aug. 22, 1985

[51] Int. Cl.[4] ..... A63B 37/12; A63B 37/14

[52] U.S. Cl. ..... 273/232; 264/239; 273/227; 273/233

[58] Field of Search ..... 273/232, 233, 234, 235 R, 273/235 A, 235 B

[56] References Cited

U.S. PATENT DOCUMENTS

| | | | |
|---|---|---|---|
| 697,421 | 4/1902 | Kempshall | 273/230 |
| 1,182,605 | 5/1916 | Wadsworth | 273/232 X |
| 1,568,514 | 1/1926 | Lewis | 273/231 X |
| 2,998,977 | 9/1961 | Molitor | 273/231 X |

*Primary Examiner*—George J. Marlo
*Attorney, Agent, or Firm*—Herbert E. Haynes, Jr.

[57] ABSTRACT

A golf ball is formed by a special method and molds so that its cover, which is formed from a pair of hemispherical cover blanks that are moldingly fused into a unitary golf ball cover, has the fused junction of the cover blanks and the molding flash produced by the molding operation extending around the golf ball in a wave form configuration. The golf ball dimple pattern includes a circular array of dimples located in the area of the molding flash which is alternately disposed on opposite sides of the circular dimple array and this allows various uninterrupted dimple patterns to be provided on the golf ball for improved dimple symmetry and flight stability. Preferred dimple patterns are provided on the golf ball so as to subdivide the surface of the cover into an uninterrupted geodesic spherical configuration defining a plurality of equilateral spherical polygons each of which contains an identical number and array of dimples.

14 Claims, 9 Drawing Figures

GOLF BALL

BACKGROUND OF THE INVENTION

1. Field of the Invention

This invention relates in general to golf balls and more particularly to an improved golf ball having the fused junction and molding flash, where two cover blanks are used to form the cover, extending around the ball in a wave form configuration to improve the bonded strength of the fused junction and to permit greater latitude in arranging dimple patterns thereon.

2. Description of the Prior Art

The usual golf ball manufacturing techniques includes the winding of an elastomeric band about a spherical elastomeric core to form the body of the golf ball. Another technique being employed by some manufacturers is to form a one-piece spherical body of a suitable elastomeric material. In either case, the golf ball body is moldingly encapsulated in a cover of synthetic resin, or plastic, such as the material known in the art as Surlyn which is a registered trademark of the Dupont Co.

The cover molding operation is accomplished by using a pair of hemispherical molds each of which has an array of protrusions machined or otherwise provided in its cavity, and those protrusions form the dimple pattern on the periphery of the golf ball during the cover molding operation. A pair of hemispherical cover blanks, of the above mentioned synthetic resin material, are placed in a diametrically opposed position on the golf ball body, and the body with the cover blanks thereon are placed in the hemispherical molds, and then subjected to a molding operation. The combination of heat and pressure applied during the molding operation results in the cover blanks being fused to the golf ball body and to each other to form a unitary one-piece cover structure which encapsulates the golf ball body. In addition, the cover blanks are simultaneously molded into conformity with the interior configuration of the hemispherical molds which results in the formation of the dimple pattern on the periphery of the golf ball cover.

As in all molding operations, when the golf ball is removed from the hemispherical molds subsequent to the molding operation, it will have molding flash, and possibly other projecting surface imperfections thereon. The molding flash will be located at the fused circular junction of the cover blanks and the parting line of the hemispherical molds. The molding flash will therefore be on a great circle of the spherical golf ball, and that great circle is sometimes referred to in the golf ball art as the "equator" of the golf ball.

The molding flash and possible other projecting surface imperfections, needs to be removed and this is normally accomplished by a grinding operation. Due to the need for grinding, the molding operation must be accomplished in such a manner that the molding flash is located solely on the surface of the golf ball and does not extend into any of the dimples. In other words, a grinding operation cannot reach into the dimples of the golf ball to remove the molding flash without ruining the golf ball cover.

Therefore, the prior art hemispherical molds are fabricated so that the protrusions formed therein are set back from the circular rims, or mouths of their cavities. This results in the equator of a molded golf ball being devoid of dimples and the molding flash being located solely on the smooth surface provided at the equator of the golf ball.

In addition to facilitating the grinding-off of molding flash, the protrusions formed in the cavities of the hemispherical molds are set back from the circular mouths of the molds to facilitate removal of the molds from the molded golf ball after completion of the molding operation. If projections were formed at the circular mouths of the molds, they would extend into dimples formed at the equator of the golf ball, and pulling the molds off of the golf ball in directions perpendicular to the plane of the equator would be difficult, if not impossible.

As is well known, the dimple pattern of a golf ball is a critical factor insofar as the flight characteristics of the ball are concerned. The dimples determine the lift and flight stability of the golf ball. When a golf ball is struck properly, it will spin about a horizontal axis and the air friction and air currents produced by the dimples of the spinning ball will act on the ball and thus determine the lift and flight stability thereof.

In order for a golf ball to achieve optimum flight stability, its dimples must be disposed symmetrically relative to a plane that is perpendicular to its horizontal axis of rotation. Any deviation from such symmetry will result in unequal air friction and air currents acting on the ball thus causing it to deviate from the intended flight path.

In that prior art golf balls are manufactured with a smooth surface along a great circle, or equator of the ball, the only possible symmetrical arrangement of the dimple patterns that can be provided on these balls is relative to the equator. In other words, the dimple arrays on the hemispherical portions on opposite sides of the equator can be symmetrically arranged with respect to each other. If such symmetry is achieved during manufacturing of a prior art golf ball, the dimple arrays will, of course, be symmetrical relative to the equator and possibly relative to a great circle which is perpendicular to the equator. The dimple pattern cannot possible be symmetrical relative to any other great circle on the spherical surface of the prior art golf balls in that the smooth surface of the equator will interrupt and thus destroy the symmetry.

Therefore, there are only two ways that a spinning golf ball of this prior art type of golf ball can possibly achieve optimum flight stability. The first condition wherein optimum flight stability could possibly be achieved is when the equator lies in the plane which is perpendicular to the horizontal axis of rotation, with the second being when the equator is oriented so that the horizontal axis of rotation passes diametrically through the equator.

Therefore, since the prior art golf balls are manufactured with a smooth surface equator, they are limited as to the symmetry of their dimple patterns and as a result, a very low percentage of golf ball flights will achieve optimum flight stability. In addition, in that the prior art golf balls are made by fusing the two hemispherical cover blanks along a great circle, that circular fused junction is a weak spot in the cover of such golf balls.

Therefore, a need exists for a new and improved golf ball, with a method and molds for making same, which overcome some of the problems and shortcomings of the prior art.

SUMMARY OF THE INVENTION

In accordance with the present invention, a new and improved golf ball is disclosed which is fabricated by a new method that includes the use of especially configured molds so that the golf ball is formed without a smooth surface lying on a great circle, or equator, as is the case in prior art golf balls. By eliminating the need for a smooth surface equator, the dimple pattern on the golf ball of the present invention need not be interrupted by the equator and therefore can be arranged so as to be symmetrical with respect to a plurality of different great circles of the golf ball and thereby significantly increase the chances of achieving flight stability of the ball.

The golf ball of the present invention is fabricated in the same basic manner as the hereinbefore described prior art technique. The golf ball body, either a one piece or a two piece structure, is placed in the above mentioned special molds with a pair of hemispherical cover blanks positioned on diametrically opposed sides of the golf ball body. Under the influence of the relatively high temperatures and pressures applied during the molding operation, the two cover blanks are fused into a unitary one-piece cover which conforms to the interior configuration of the molds and is encapsulatingly fused to the golf ball body.

The fused junction of the cover blanks of the prior art golf ball is, as hereinbefore described, of circular configuration which lies on a great circle of the golf ball. The fused junction of the golf ball of the present invention circumscribes the golf ball but is of a wave form configuration as opposed to circular. In other words, the fused wave form junction is alternately disposed on one side of a great circle and the other and thus repeatedly crosses but never extends on that great circle.

To achieve the wave form fused junction of the golf ball of the present invention, the generally hemispherical molds are formed with matching wave form mouths or rims which surround the openings of the cavities thereof. The wave form mouths, or rims, of the molds may be of substantially square wave, undulatory or equivalent form to provide an endless alternating series of land areas and recessed areas. When used to moldingly form the cover of the golf ball, the molds are aligningly positioned so that the land areas of one mold are nestingly disposed in the recessed areas of the other mold.

In that the fused junction of the golf ball of the present invention is of wave form configuration, a considerably larger extent of the fused surfaces of the cover blanks is provided which increases the strength of the fused junction in comparison to the circular junction of the prior art.

The special molds are further provided with protrusions in the cavities thereof which form the dimples on the golf ball cover during the molding operation. Due to the wave form configuration being formed on the mouths of the molds, protrusions may be provided on the inwardly facing surfaces of the land areas, and those protrusions result in dimples being formed in the fused junction area of the golf ball of the present invention where the prior art golf balls are devoid of dimples.

Since the dimples formed in the fused junction area of the golf ball are formed by protrusions located on the inner surfaces of the lands of the molds, the molds can be removed from a molded golf ball due to the land areas being radially deflected during removal.

In that the smooth surface equator of the prior art has been eliminated in the manner discussed above, the dimple pattern on the golf ball of the present invention can be arranged in an uninterrupted manner which heretofore could not be accomplished. As a result of this, the golf ball of this invention can be provided with virtually any dimple pattern, For example, dimple pattern of the golf ball of the present invention may be arranged so that the dimples subdivide the spherical surface of the ball into a geodesic spherical configuration derived from a geometric solid known as a regular polygon, with the regular polygon being a regular dodechedron, a regular icosahedron or the like. To more fully appreciate the advantages of such dimple patterns, the following explanation is presented. A regular icosahedron is a solid whose surface is made up of twenty equilateral triangles. Therefore, a geodesic sphere derived from such a solid has its surface subdivided into twenty equilateral spherical triangles. The dimple pattern of this example is arranged on the surface of the golf ball so as to define the twenty equilateral spherical triangles and provide an identical number and array of dimples within the included area of each of those triangles. With the dimple pattern arranged in this manner, the dimple pattern is perfectly symmetrical with respect to fifteen different great circles of the spherical golf ball, and is very close, but not quite perfectly symmetrical, with respect to an additional multiplicity of great circles.

Therefore, the golf ball of the present invention with a dimple pattern arranged in that manner will significantly increase the chances of achieving flight stability in comparison to prior art golf balls. And, in addition, significantly reduces deviation of a golf ball from the intended flight path when none of the fifteen different great circles of perfect symmetry happens to lie in a plane that is perpendicular to the horizontal axis of rotation of a spinning golf ball.

Accordingly, it is an object of the present invention to provide a new and improved golf ball.

Another object of the present invention is to provide a new and improved golf ball having significantly improved flight stability.

Another object of the present invention is to provide a new and improved golf ball wherein the fused junction of the two hemispherical cover blanks used in forming the golf ball cover is of wave form configuration to increase the strength of the fused junction and so that dimples may be formed in the junction area to allow uninterrupted dimple patterns to be arranged on the golf ball.

Another object of the present invention is to provide a new and improved golf ball of the above described character which allows a dimple pattern to be arranged thereon which is perfectly symmetrical to a multiplicity of great circles of the golf ball for improved flight stability.

Another object of the present invention is to provide a new and improved golf ball of the above described character having a dimple pattern which subdivides the surface of the golf ball into a geodesic spherical configuration derived from various geometric solids known as regular polygons so that the golf ball dimple pattern defines a multiplicity of equilateral spherical polygons with an identical number and array of dimples within the included areas of each of those polygons to provide perfect symmetry of the dimple pattern relative to a plurality of different great circles of the golf ball.

Another object of the present invention is to provide a new and improved method for fabricating golf balls wherein the two hemispherical cover blanks used in molding the golf ball cover are formed with a fused junction of wave form configuration to allow uninterrupted dimple patterns to be arranged on the golf ball.

Still another object of the present invention is to provide new and improved molds for use in forming two hemispherical cover blanks into a fused unitary golf ball encapsulating cover having a fused junction of wave form configuration and having an uninterrupted dimple pattern arranged on the cover of the golf ball.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
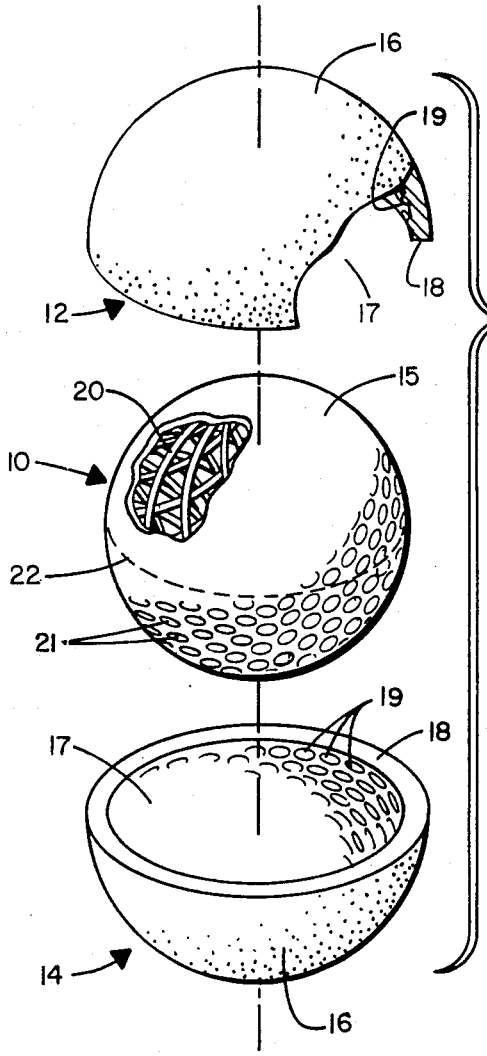
Fig. 1 PRIOR ART
FIG. 1 is a perspective exploded view showing a typical prior art golf ball and the molds used in forming the cover thereof.

Before proceeding with the detailed description of the present invention, it is believed that a brief discussion of a typical prior art golf ball molding method, the molds used and the golf ball produced thereby, will help in achieving a full understanding of the present invention, and reference is made to FIG. 1 for that purpose.

FIG. 1 shows a typical prior art golf ball 10 with the molds 12 and 14 that are used to moldingly form a cover 15 on the ball. The molds 12 and 14 each include a mold body 16 which defines an internal cavity 17 of hemispherical configuration. The mold bodies 16 each have a mouth, or rim 18 which circumscribes the openings of the cavities 17 and the mouths lie in a flat plane and are of circular configuration. In addition, the mold body 17 of each of the molds 12 and 14 has an array of protrusions 19 which extend into their respective cavities 17.

When a prior art molding operation is to be started, a pair of cover blanks (not shown) of suitable synthetic resin are placed on diametrically opposed sides of a golf ball body 20 so as to be above and below the body. The golf ball body and the cover blanks are placed between the molds 12 and 14 and a suitable molding machine (not shown) is used to close the molds so that their mouths 18 are in contiguous engagement with each other. The molding machine applies relatively high temperatures and pressures to the molds to fuse the cover blanks into the unitary golf ball cover 15 with the body 20 encapsulated therein. The molding operation simultaneously molds the cover 20 so that it conforms to the interior configuration of the cavities 17 of the molds so that the protrusions 19 thereof form the predetermined dimple pattern 21 on the cover.

As in all molding operations, the golf ball 10 will have molding flash (not shown) thereon when it is removed from the molds 12 and 14. The molding flash will be located at the fused junction 22 (shown in dotted lines in FIG. 1) of the cover blanks e.g., where the contiguously engaged mouths 18 of the molds 12 and 14 were located during the molding operation.

The molding flash must be removed from the golf ball 10 subsequent to its removal from the molds 12 and 14, and this is usually accomplished by a grinding operation. In that a grinding operation cannot reach down into the dimples, the molds 12 and 14 are designed so that the protrusions 19 are set back from the mouths 18 thereof as shown. Therefore, the fused junction 22 of the cover 15 is of circular configuration, lies on a great circle of the spherical golf ball, is devoid of dimples, and the molding flash is located on the smooth surface which is coextensive with the fused junction. Such a smooth surface fused junction is sometimes referred to in the art as the "equator" of the golf ball. The set back protrusions also facilitate mold alignment and removal of the golf ball 10 from the molds 12 and 14. If protrusions were formed along the mouths of the molds 12 and 14, it would be necessary to form half of each protrusion in one mold and the other half in the other mold. This would make mold registration critical and in a mass production environment, this would be difficult to achieve. In addition, such protrusions would be at right angles with respect to the direction in which the molds are moved away from the golf ball subsequent to molding, and this would make it difficult, if not impossible to remove the ball from the molds.

Figure 2:
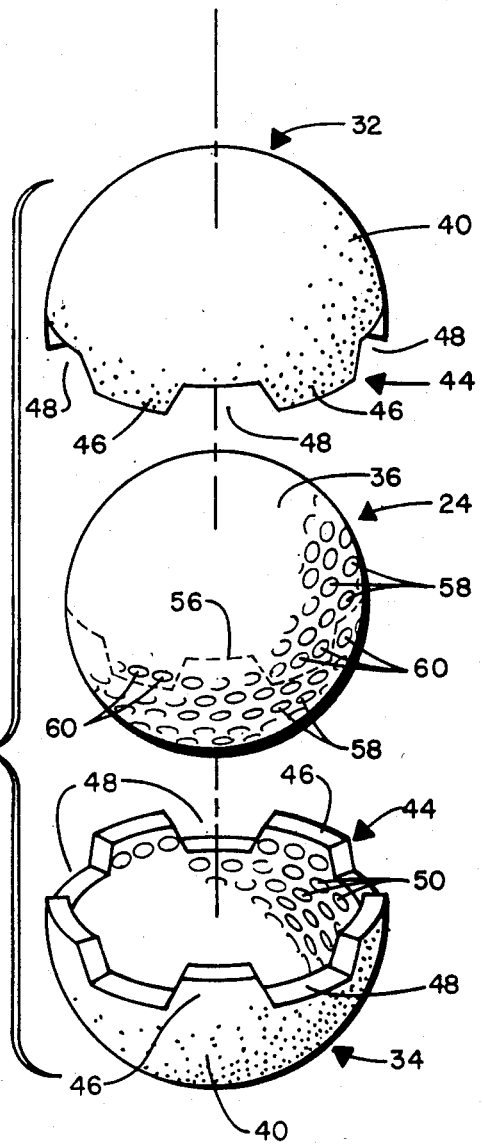
FIG. 2 is a perspective exploded view showing the golf ball of the present invention and the preferred configuration of the new molds used in forming the cover thereof.
Figure 3:
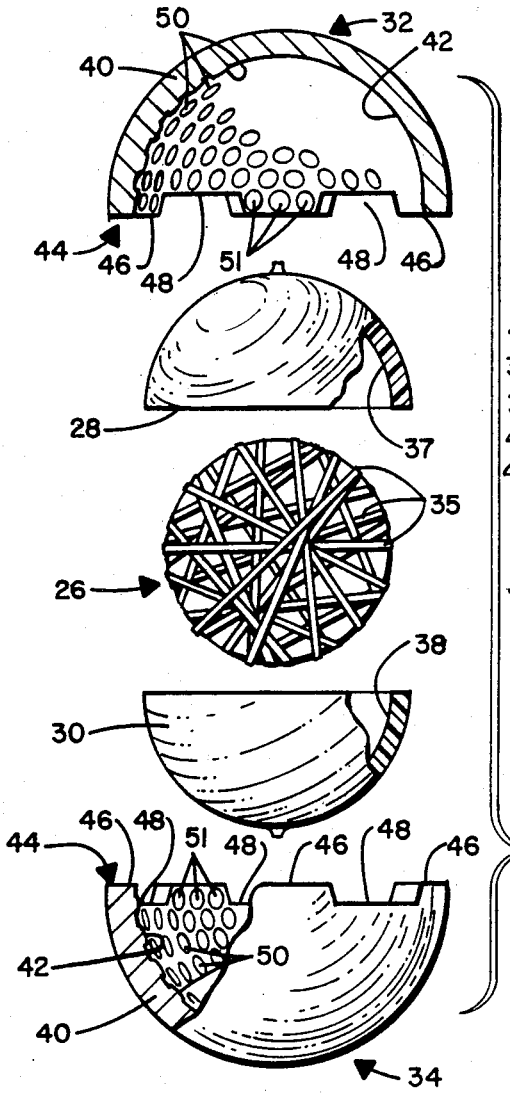
FIG. 3 is an orthographic exploded view of a golf ball body, a pair of diametrically opposed cover blanks and the preferred configuration of the molds used in forming the golf ball of the present invention.
Figure 4:
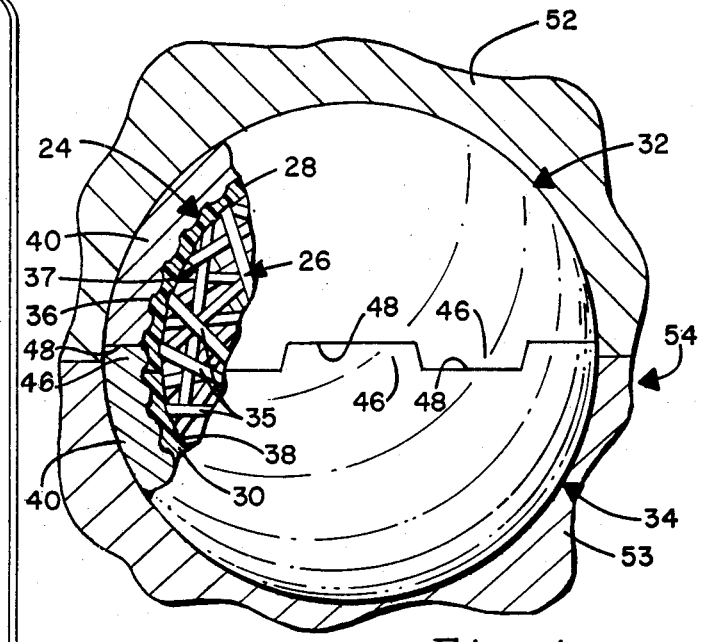
FIG. 4 is a sectional view taken on a vertical plane through a molding machine to show the molds and the golf ball therein with the molds and the ball being partially broken away to show the various features thereof.
Figure 5:
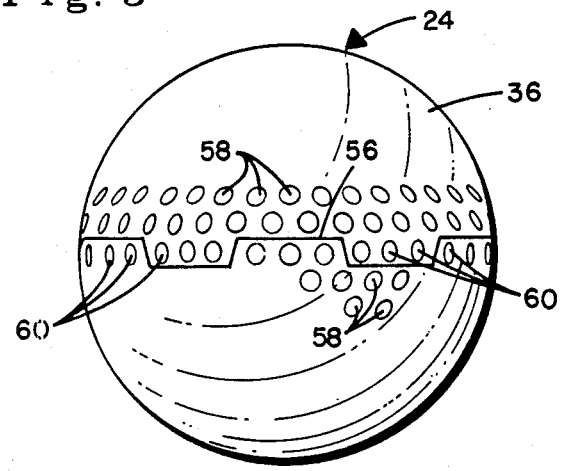
FIG. 5 is an orthographic view of the golf ball of the present invention having the preferred fused junction of wave form configuration and showing the ball as it would appear subsequent to removal from the molds and before having the molding flash removed therefrom.

Reference is now made to FIGS. 2, 3, 4 and 5 wherein the improved golf ball of the present invention is shown, with the golf ball being indicated generally in FIGS. 2, 4 and 5 by the reference numeral 24. As will hereinafter be described in detail, these figures also show a golf ball body 26, a pair of cover blanks 28 and 30 which are the parts from which the golf ball is made, and a pair of especially configured molds 32 and 34 which are used in fabricating the ball.

As is customary in the art, the golf ball body 26 is formed by wrapping an elastomeric core (not shown) in elastomeric bands 35. When formed in this manner, the resulting ball is commonly referred to as a three-piece golf ball in that it includes a core (not shown), the wrapping bands 35 and a cover 36 which is formed of the two cover blanks 28 and 30 as will hereinafter be described. Another type of golf ball is commonly referred to as a two-piece ball and is similar to the three-piece ball except that the golf ball body is not provided with a core.

The two cover blanks 28 and 30, again as is customary in the art, are of hemispherical configuration defining cavities 37 and 38, respectively, into which the golf ball body 26 is placed at the beginning of a molding operation. The cover blanks 28 and 30 are formed of a suitable synthetic resin such as that referred to as Surlyn which is a registered trademark of the Dupont Company.

The special molds 32 and 34 each include a mold body 40 which defines an internal cavity 42 of generally hemispherical configuration with a rim means 44 circumscribing the opening of the cavity 42. The rim means 44 is of wave form configuration which in this embodiment may be defined as a castellated, or substantially square wave form. In other words, the rim means 44 is provided with an alternating series of lands 46 and recesses, or notches 48. As will hereinafter be described in detail, when the molds 32 and 34 are put together, or closed, for a molding operation, the lands 46 of the mold 32 are nestingly received in the notches 48 of the mold 34 and similarly, the lands 46 of the mold 34 are nestingly received in the notches 48 of the mold 32, and this nesting relationship is shown in FIG. 4.

Each of the molds 32 and 34 are also provided with an array of protrusions 50 which extend into their cavities 42, and for reasons which will become apparent as this description progresses the interior surfaces of the lands 46 are provided with protrusions 51 thereon.

FIG. 4 shows the molds 32 and 34 as being in position within the separable halves 52 and 53 of a suitable molding machine 54, with the golf ball body 26 and the cover blanks 28 and 30 being positioned within the cavities 42 of the molds.

Due to the starting temperatures and relative sizes of the molds, cover blanks and the golf ball body, the molding operation starts with a warm-up mode. In the warm-up mode, the molds are heated to a temperature of about 300°–350° F. and the separable halves 52 and 53 are forced toward each other to apply a pressure of approximately 600 PSI on the molds 32 and 34 and thus the cover blanks 28 and 30. These temperature and pressure conditions are maintained until the cover blanks are warmed up to a point where they are plastic, or nearly so. In a typical situation, depending on the molding machine, cover materials and the like, this warm-up period will take about 2½ to 3½ minutes.

When the warm-up mode is completed, a molding mode is started. The temperatures are maintained in the same range as in the warm-up mode, e.g., about 300°–350° F., but the pressure is raised into the range of between 2000 and 3000 PSI. With this type of pressure, the cover blanks 28 and 30 will be nearing, or in the molten state, and will thus flow so as to conform with the interior configuration of the cavities 42 of the molds 32 and 34. When this occurs, the molds will be simultaneously moved into a locked together condition. This molding mold is maintained for approximately one minute to insure that the cover blank materials are in complete conformity with the interior mold configuration and that the two cover blanks become fused into the unitary golf ball cover structure 36.

Upon completion of the molding operational mode, a cooling operational mode is started. In this last mode, the pressure is maintained at the same level as in the molding mold, e.g., 2000 to 3000 PSI, and the molds are cooled to a temperature of about 40° F. The cooling mode, which is maintained for about seven or eight minutes, will set the material of the cover 36, and when completed, the golf ball 24 will be ready for extraction from the molds.

When the cover blank materials change from the plastic state to the molten state, the molds 32 and 34 will be allowed to move into the locked together state as mentioned above. When this occurs, air will be expelled from the interior of the molds and some of the molten cover materials will invariably move with the expelled air. This material will be set during the cooling operational mode and is commonly referred to as molding flash, and will be located at the parting line of the molds 32 and 34 which is also the approximate fused junction where the cover blanks 28 and 30 are fused into the unitary cover 36. The golf ball 24 shown in FIG. 4 shows the fused junction at 56 of substantially square wave configuration, which would not be visible at all if it were not for the presence of molding flash.

It will be appreciated that due to the molten state of the cover materials during the above described molding operation, the above mentioned fused junction 56 will not be identifiable as being formed exactly along the wave form shape shown at 56 in FIG. 4 but will instead be located in that general area and will follow that general wave form configuration. The important thing about all this is that the molding flash will circumscribe the golf ball 24 in the illustrated wave form configuration.

As is customary in the art, molding flash is removed from the golf ball subsequent to the molding operation such as by a grinding operation. In that the molding flash is located totally on the surface of the golf ball cover 36, as opposed to being in any dimples, removal of the molding flash can be easily accomplished without damaging the golf ball cover 36.

As hereinbefore described, during the molding operation, the cover materials will flow into conformity with the interior configuration of the molds 32 and 34. Thus, the golf ball 24 will be provided with a plurality of dimples 58 provided by the protrusions 50 of the molds 32 and 34. As hereinbefore mentioned, the interior surfaces of the lands 46 of the molds 32 and 34 are provided with the protrusions 51 and those protrusions result in the circular array of dimples 60 which circumscribe the golf ball along the fused junction 56 of the golf ball.

Figure 6:
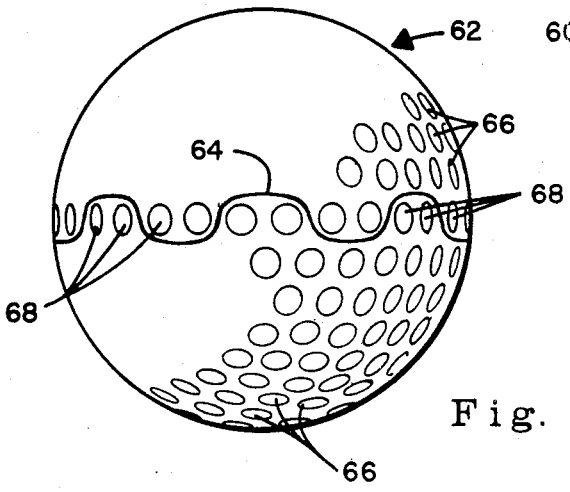
FIG. 6 is a view similar to FIG. 5 and showing the golf ball of the present invention as having fused junction of another wave form configuration.

Referring now to FIG. 6 wherein a modified form of the golf ball of the present invention is indicated in its entirety by the reference numeral 62. This golf ball 62 is formed in the same general manner as the hereinbefore fully described golf ball 24 with the exception of its fused junction 64 and molding flash which circumscribe the ball 62 in a wave form of undulatory configuration. Therefore, the golf ball 62 is provided with a plurality of dimples 66 and the substantially circular array of dimples 68 which circumscribe the golf ball 62 in a manner coextensive with the great circle about which the wave form fused junction is undulatory.

In that the golf balls 24 and 62 of the present invention are formed with the circular arrays of dimples 60 and 68, respectively, along their fused junctions, as opposed to the prior art smooth surface fused junction 22 (FIG. 1), various arrays of uninterrupted dimple patterns can be arranged on the golf balls. And, the various arrays can be selected, as desired, to achieve symmetry and thus improve golf ball flight stability.

Figure 7:
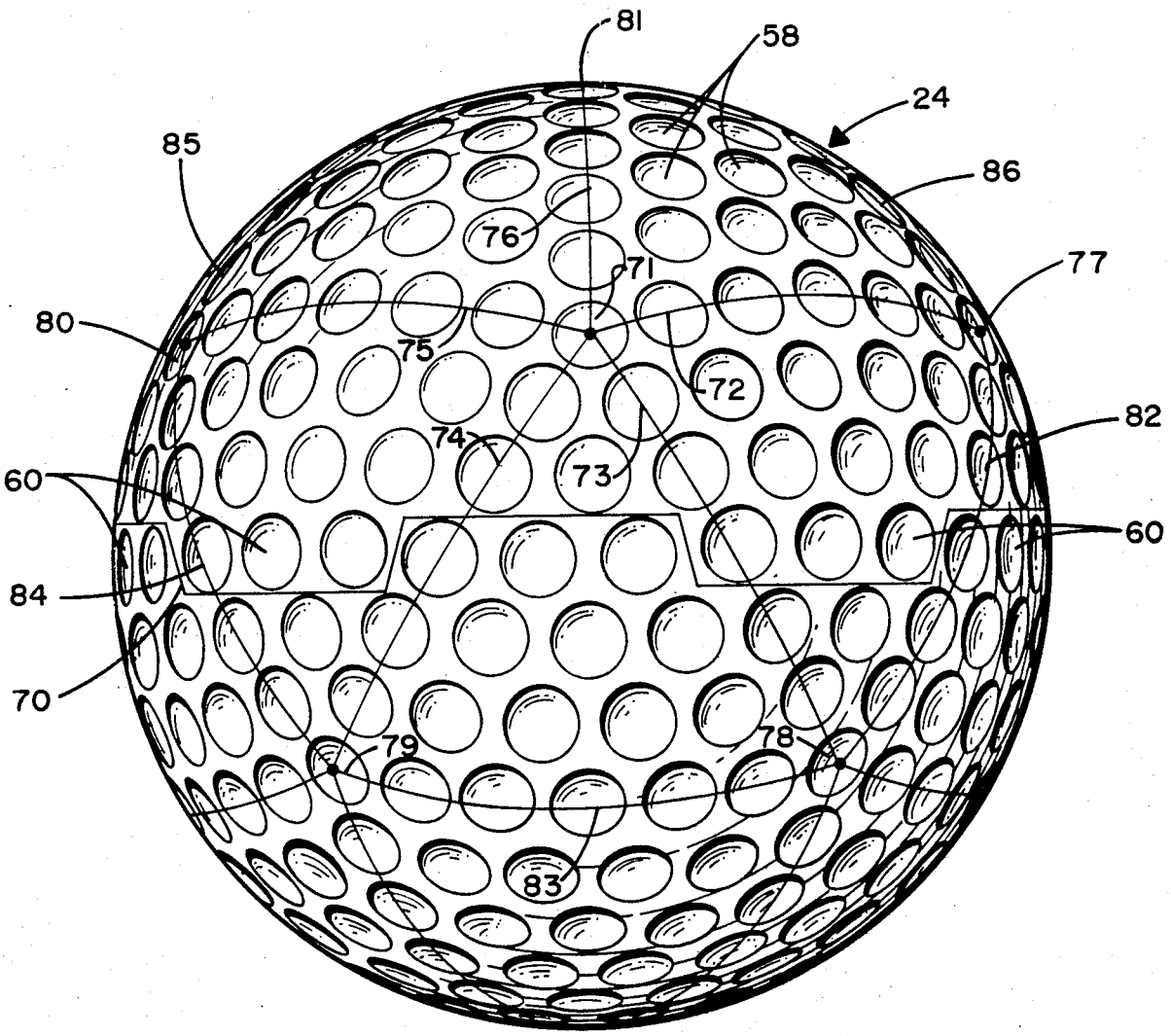
FIG. 7 is an enlarged elevational view of the golf ball having the wave form fused junction and having an example of an improved dimple pattern thereon.
Figure 8:
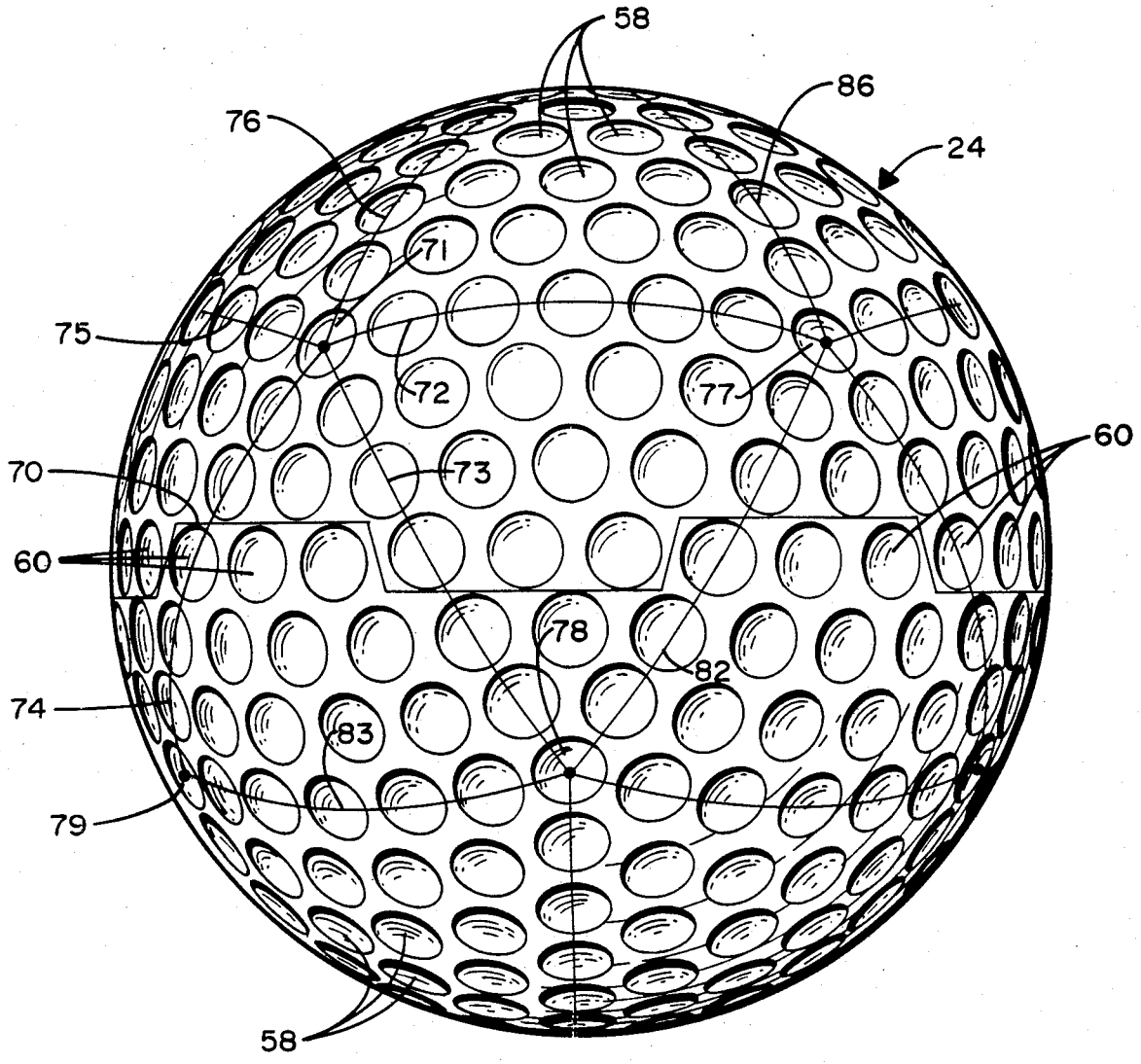
FIG. 8 is another view of the golf ball shown in FIG. 7 with the golf ball having been rotated in this view through 37.5° about a vertical axis in either direction from the view of FIG. 7.
Figure 9:
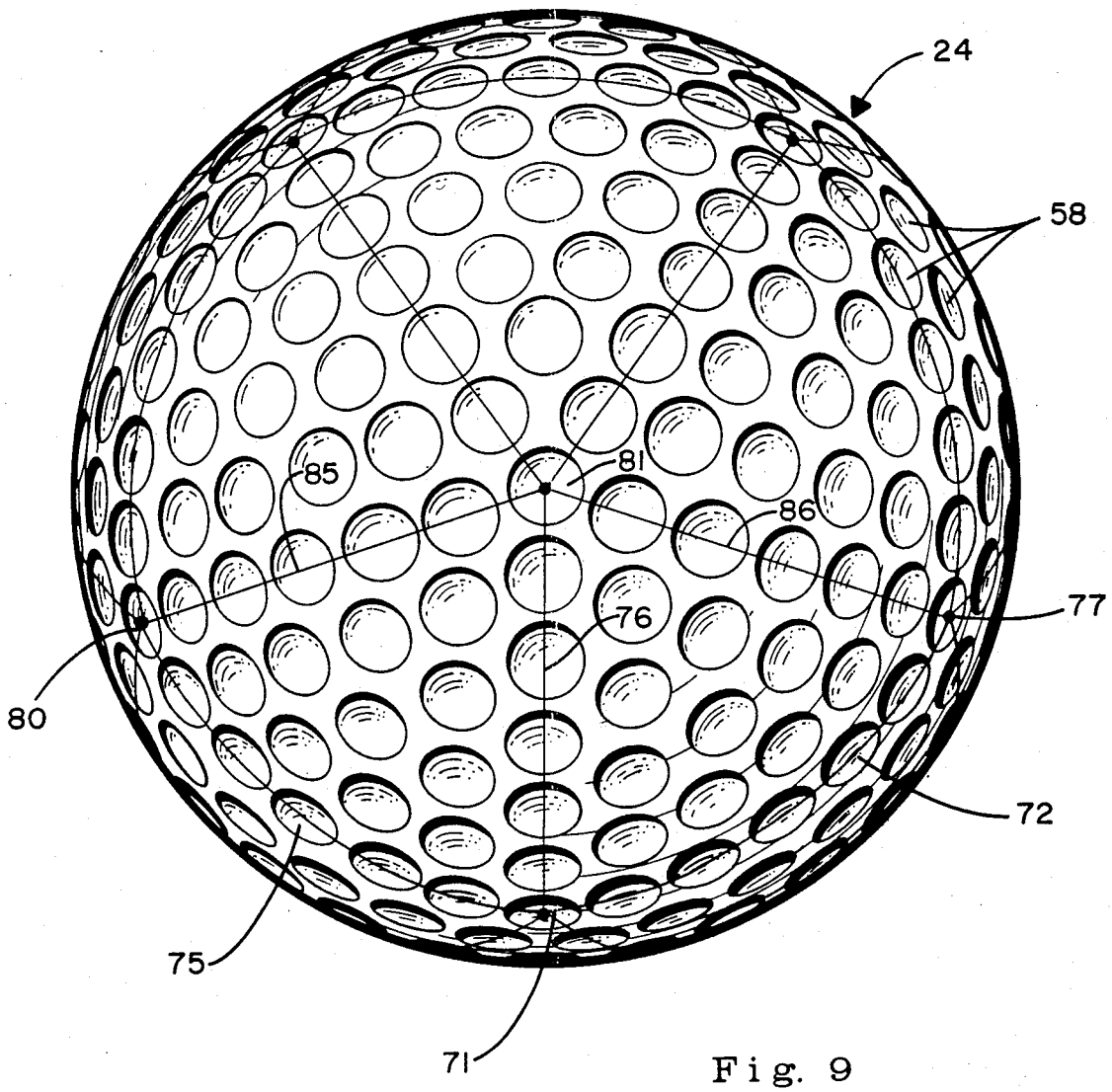
FIG. 9 is still another view of the golf ball shown in FIGS. 7 and 8 with this view showing the ball as it would appear after being rotated 90° about a horizontal axis in either direction from the view shown in FIG. 8.

Reference is now made to FIGS. 7, 8 and 9 wherein the golf ball 24 of the present invention is shown with one example of an improved uninterrupted dimple pattern thereon. The illustrated dimple pattern may be described as subdividing the spherical surface of the golf ball into a geodesic spherical configuration including a plurality of equi-lateral polygons. To insure a clear understanding of these terms the following explanation is provided.

The term geodesic is defined as the shortest line between two points on a mathematically derived surface. The intersection of a plane passed through a sphere forms a circular cross section. The shortest line between two points on a sphere lies along the intersection of a plane passed through the center of the sphere, e.g., a great circle, which includes the two points. An arrangement of grid lines laid out on the surface of the sphere along the great circles of the sphere are therefore geodesic.

In the interest of dimple pattern symmetry, the grid pattern which subdivides the surface of the golf ball into the geodesic spherical configuration must be laid out with some degree of logical consistency and it is felt that this is best achieved by deriving the grid pattern from a geometric solid of the type known as regular polyhedra such as an octahedron, dodechedron, icosahedron, and the like.

The dimple pattern illustrated in FIGS. 7, 8 and 9 subdivides the spherical surface of the golf ball 24 into a geodesic spherical configuration, the grid lines of which are derived from a regular icosahedron which is defined as a solid having its surface made up of twenty equilateral triangles. Therefore, the geodesic sphere derived from such a solid has its surface formed of twenty equilateral spherical triangles.

To illustrate this, FIG. 7 is provided with imaginary grid lines to better illustrate the geodesic dimple pattern and the fused junction of the golf ball. The imaginary line 70, of course, shows the fused junction of the ball. The ball has a first vertex, or node 71 from which the imaginary grid lines 72, 73, 74, 75 and 76 extend, with each of those lines extending to other nodes 77, 78, 79, 80 and 81, respectively. It will be understood that node 81 does not appear in FIG. 7 due to the position of the ball but does appear in FIG. 9. An imaginary grid line 82 extends between the nodes 77 and 78, line 83 extends between nodes 78 and 79, line 84 extends between nodes 79 and 80, line 85 extends between nodes 80 and 81, and line 86 between nodes 81 and 77.

As seen, each of the imaginary grid lines 71–76 and 82–86 follow a different aligned row of dimples and each represents a side of two adjacent spherical triangles. More specifically, lines 73, 74 and 83 define one of the twenty equilateral spherical triangles, lines 73, 72 and 82 define another one of the twenty triangles, lines 74, 75 and 84 defines still another one, and so forth.

FIG. 8 shows the golf ball 24 as having been rotated through 37.5° about a vertical axis from the position shown in FIG. 7, and FIG. 9 shows the ball as it appears after being rotated 90° about a horizontal axis. These two figures in conjunction with FIG. 7 clearly shows that the dimples 58 and 60 are arranged on the golf ball to define the twenty equilateral spherical triangles which are inherently provided by a geodesic sphere derived from a regular icosahedron, and that each of those triangles contains an identical number and array of dimples.

The above described dimple pattern is perfectly symmetrical with respect to fifteen different great circles of the spherical golf ball 24 with such symmetry providing significantly improved flight stability of the ball. And, this dimple pattern is nearly symmetrical with respect to a further multiplicity of great circles of the golf ball.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A golf ball comprising:
(a) a spherical golf ball center;
(b) an outer cover encapsulating said golf ball center, said cover being formed from a pair of cover blanks which are fused together to provide said cover with a fused junction which extends around said golf ball center in a path which alternately varies from one side to the other of a great circle of said cover to provide an alternating array of oppositely extending protrusions and recesses; and
(c) a plurality of dimples formed in said cover with some of said plurality of dimples being located in the alternating array of oppositely extending protrusions and recesses so as to be substantially coextensive relationship with said great circle of said cover.

2. A golf ball as claimed in claim 1 wherein the alternatingly varying path of said fused junction is symmetrical with respect to great circle.

3. A golf ball as claimed in claim 1 wherein the alternatingly varying path of said fused junction is of curvilinear configuration so as to avoid intersection with any of said plurality of dimples.

4. A golf ball as claimed in claim 1 wherein the alternatingly varying path of said fused junction is in the form of a series of linear lines arranged to avoid intersection with any of said plurality of dimples.

5. A golf ball as claimed in claim 1 wherein each of said alternating array of oppositely extending protrusions and recesses is defined by a curved line portion of said fused junction.

6. A golf ball as claimed in claim 1 wherein each of said alternating array of oppositely extending protrusions and recesses is defined by a portion of said fused junction having a linear bight portion which is spaced from and parallel with respect to said great circle and a pair of linear lines which extend from opposite ends of said bight portion across said great circle.

7. A golf ball as claimed in claim 1 wherein said plurality of dimples are arranged in a pattern which subdivides said cover into a geodesic spherical array having a plurality of equilateral spherical polygons each of which contains an identical number and array of the dimples of said plurality of dimples.

8. A golf ball comprising:
(a) a spherical center;
(b) an outer cover of spherical configuration encapsulatingly molded on said center, said cover being formed of a pair of cover blanks which are fused together to provide a fused junction from which molding flash extends, said molding flash being disposed around said cover in a path which alternately varies from one side to the other of a great circle of said cover so as to define an alternating series of oppositely extending protrusions and recesses; and (c) a plurality of dimples formed in said cover some of which are located in the alternating series of oppositely extending protrusions and recesses so as to be substantially coextensive with said great circle of said cover.

9. A golf ball as claimed in claim 8 wherein said extending molding flash alternatingly varies in a path which is symmetrical with respect to the great circle of said cover.

10. A golf ball as claimed in claim 8 wherein said extending molding flash alternatingly varies in a path of curvilinear configuration so as to avoid intersection with any of said plurality of dimples.

11. A golf ball as claimed in claim 8 wherein said extending molding flash alternatingly varies in a path formed of an endless series of linear lines arranged to avoid intersection with any of said plurality of dimples.

12. A golf ball as claimed in claim 8 wherein each of said alternating array of oppositely extending protrusions and recesses is defined by a segment of said extending molding flash which is of curved configuration.

13. A golf ball as claimed in claim 8 wherein each of said alternating array of oppositely extending protrusions and recesses is defined by a segment of said molding flash which includes a linear bight portion that is spaced from and parallel with respect to said great circle of said cover and also includes a pair of linear line portions which extend from opposite ends of said bight portion across said great circle of said cover.

14. A golf ball as claimed in claim 8 wherein said plurality of dimples are arranged in a pattern which subdivides said cover into a plurality of geodesic spherical polygons each containing an identical number and array of the dimples of said plurality of dimples.

* * * * *